US008899636B2

(12) United States Patent
Fitzgerald et al.

(10) Patent No.: US 8,899,636 B2
(45) Date of Patent: Dec. 2, 2014

(54) MAGNETIC LATCH

(75) Inventors: Richard W. Fitzgerald, Franklin, WI (US); Dana K. Leland, Milwaukee, WI (US)

(73) Assignee: Eaton Corporation, Cleveland, OH (US)

( * ) Notice: Subject to any disclaimer, the term of this patent is extended or adjusted under 35 U.S.C. 154(b) by 252 days.

(21) Appl. No.: 13/335,143

(22) Filed: Dec. 22, 2011

(65) Prior Publication Data

US 2013/0161962 A1 Jun. 27, 2013

(51) Int. Cl.
*E05C 17/56* (2006.01)
*E05C 19/16* (2006.01)

(52) U.S. Cl.
USPC ..... 292/251.5

(58) Field of Classification Search
CPC ..... E05Y 2201/46
USPC ..... 292/1, 251.5; 40/653, 662; 16/320; 70/276, 413
See application file for complete search history.

(56) References Cited

U.S. PATENT DOCUMENTS

| | | | | |
|---|---|---|---|---|
| 1,493,413 | A * | 5/1924 | Anderson | 200/330 |
| 1,701,202 | A * | 2/1929 | Dudley | 16/82 |
| 2,524,924 | A * | 10/1950 | Pampallona | 292/251.5 |
| 3,261,631 | A * | 7/1966 | Frank | 292/251.5 |
| 3,671,893 | A | 6/1972 | Edgar et al. | |
| 4,697,442 | A | 10/1987 | Stendal | |
| 4,901,704 | A | 2/1990 | Safranek | |
| 4,999,599 | A | 3/1991 | Spier | |
| 5,485,733 | A * | 1/1996 | Hoffman | 70/276 |
| 5,621,317 | A | 4/1997 | Wozniak | |
| 5,752,595 | A | 5/1998 | Fein et al. | |
| 6,349,984 | B1 * | 2/2002 | Marrazzo et al. | 292/336.3 |
| 6,408,484 | B1 * | 6/2002 | Vandertouw | 16/320 |
| 6,831,541 | B1 * | 12/2004 | Seidler | 335/306 |
| 6,929,291 | B2 * | 8/2005 | Chen | 292/251.5 |
| 7,089,627 | B2 | 8/2006 | Seidler | |
| 7,424,785 | B2 * | 9/2008 | Feroli et al. | 40/649 |
| 7,467,440 | B2 * | 12/2008 | Seidler | 16/320 |
| 7,583,500 | B2 * | 9/2009 | Ligtenberg et al. | 361/679.27 |
| 7,661,732 | B2 | 2/2010 | Hsu et al. | |
| 7,775,567 | B2 * | 8/2010 | Ligtenberg et al. | 292/251.5 |
| 7,845,953 | B2 | 12/2010 | Brock et al. | |
| 7,915,986 | B2 | 3/2011 | Lu | |
| 7,931,313 | B2 | 4/2011 | Carabalona | |
| 7,945,997 | B2 | 5/2011 | Wang | |
| 8,015,666 | B2 | 9/2011 | Wang | |

(Continued)

FOREIGN PATENT DOCUMENTS

EP 1864757 A1 12/2007

*Primary Examiner* — Kristina Fulton
*Assistant Examiner* — Faria Ahmad
(74) *Attorney, Agent, or Firm* — Benesch Friedlander Coplan & Aronoff LLP

(57) ABSTRACT

A flip cover latch assembly includes a base component, and a flip cover pivotally connected to the base component and configured to pivot between an opened position and a closed position. A first magnet is disposed on the base component at the closed position. The first magnet has a polarity that attracts the flip cover. A second magnet is disposed on the base component at an intermediate position between the closed position and the opened position. The second magnet has a polarity that repels the flip cover. A third magnet is disposed on the base component at the opened position. The third magnet having a polarity that attracts the flip cover.

18 Claims, 5 Drawing Sheets

(56) References Cited

U.S. PATENT DOCUMENTS

| | | | | |
|---|---|---|---|---|
| 8,016,330 | B2 | 9/2011 | Fullerton et al. | |
| 8,062,108 | B2 | 11/2011 | Carlson et al. | |
| 2005/0023841 | A1* | 2/2005 | Chen | 292/251.5 |
| 2007/0138806 | A1 | 6/2007 | Ligtenberg et al. | |
| 2007/0157432 | A1 | 7/2007 | Weinstein | |
| 2008/0309098 | A1 | 12/2008 | Hsu et al. | |
| 2011/0026203 | A1* | 2/2011 | Ligtenberg et al. | 361/679.01 |
| 2011/0138572 | A1 | 6/2011 | Stuart | |

* cited by examiner

MAGNETIC LATCH

FIELD OF INVENTION

The present disclosure relates to a latch assembly. More particularly, the present disclosure relates to a latch assembly that is biased towards an opened position or a closed position.

BACKGROUND

Spring latches are known to have a movable component pivotally connected to a base component. In one known embodiment, the movable component is mechanically retained in a closed position, while a torsion spring biases the movable component towards an opened position. When an initial force is applied to the movable component to overcome the retention force, the torsion spring moves the movable component to the opened position. In another known embodiment, a tension spring is used to create rotational force vectors to open or close a movable component as it is moved to one side or the other of a radial centerline. This may be referred to as an over-center spring latch.

SUMMARY OF THE INVENTION

In one embodiment, a latch includes a base component having at least one substantially planar surface, and a movable component pivotally connected to the base component adjacent to the substantially planar surface. The movable component is configured to pivot between the closed position and the opened position. At least three base magnets are disposed on the substantially planar surface of the base component, such that the centerlines of the base magnets define a first arcuate path. The base magnets include a first base magnet having a first polarity and defining the closed position. The base magnets also include a second base magnet having a second polarity opposite the first polarity, and a third base magnet having the first polarity and defining the opened position. At least one magnet is disposed on the movable component such that a centerline of the magnet moves along a second arcuate path as the movable component pivots between the closed position and the opened position. The magnet has the second polarity opposite the first polarity.

In another embodiment, a flip cover latch assembly includes a base component having at least a first magnet, a second magnet, and a third magnet disposed thereon. The flip cover latch assembly further includes a flip cover pivotally connected to the base component and configured to pivot between an opened position and a closed position. The flip cover has a fourth magnet disposed thereon. The first magnet defines the closed position, and has a polarity that attracts the fourth magnet. The second magnet defines an intermediate position between the closed position and the opened position, and has a polarity that repels the fourth magnet. The third magnet defines the opened position, and has a polarity that attracts the fourth magnet.

In yet another embodiment, a magnetic latch assembly includes a base component, and a movable component pivotally connected to the base component and movable between an opened position and a closed position. The magnetic latch assembly further includes first means for biasing the movable component towards the opened position, and second means for biasing the movable component towards the closed position.

In still another embodiment, a flip cover latch assembly includes a base component having at least three magnets disposed thereon. The at least three magnets include first, second, and third base component magnets. A flip cover is pivotally connected to the base component and configured to pivot between an open position and a closed position. The flip cover includes a flip cover magnet disposed thereon. The first and second base component magnets act on the flip cover magnet to bias the flip cover to the open position. The second and third base component magnets act on the flip cover magnet to bias the flip cover to the closed position.

BRIEF DESCRIPTION OF THE DRAWINGS

In the accompanying drawings, structures are illustrated that, together with the detailed description provided below, describe exemplary embodiments of the claimed invention. Like elements are identified with the same reference numerals. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

Figure 1:
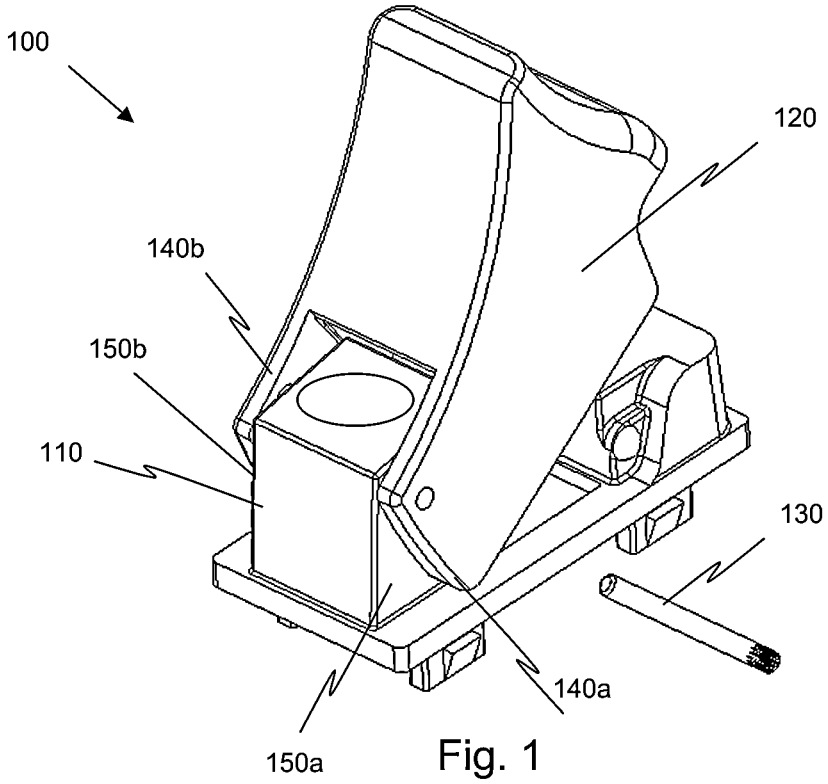
FIG. 1 is an exploded view of one embodiment of a latch assembly in an opened position.

FIG. 1 is an exploded view of one embodiment of a latch assembly 100 including a base component 110 and a movable component 120. The movable component 120 is pivotally connected to the base component 110 by a pin 130 that is press fit into the latch assembly 100, such that the movable component 120 can pivot relative to the base component 110 between opened and closed positions.

In the illustrated embodiment the moving component 120 includes spaced-apart first and second sidewalls 140*a,b* disposed about the base component 110 and adjacent to first and second substantially planar surfaces 150*a,b* of the base component 110. In an alternative embodiment (not shown), the base component has surfaces that surround the first and second sidewalls of the moving component.

The pin 130 extends through the first sidewall 140*a*, the base component 110, and the second sidewall 140*b*. In an alternative embodiment (not shown), a pair of smaller pins may be employed instead of the illustrated pin, wherein each pin extends though one sidewall of the movable component, and further extends into a portion of the base component. In another alternative embodiment (not shown), posts may extend from the base component or the movable component and be received in apertures of the adjacent component. It should be noted, however, that the assembly is not limited to one or more pivot pins. Rivets, shoulder screws or other mechanical fasteners which permit rotational movement between the base and the moving component may also be employed.

Figure 2:
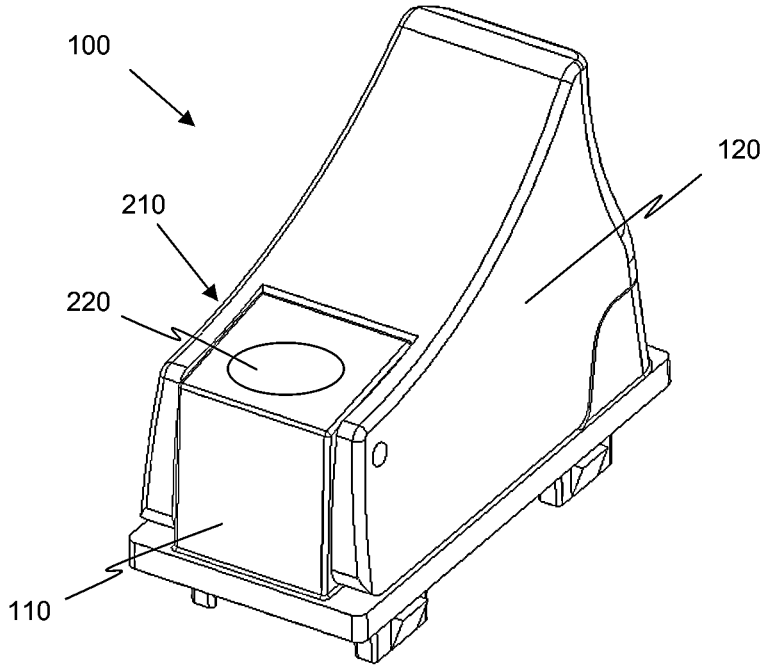
FIG. 2 is a perspective view of the latch assembly in a closed position.

FIG. 2 is a perspective view of the latch assembly 100 in the closed position. In the illustrated embodiment, the latch assembly 100 is a flip cover latch assembly. The movable component 120 is a flip cover that is dimensioned to cover a toggle switch, button, or other input receiving device (not shown) when the flip cover is in the closed position, thereby preventing accidental actuation of the input receiving device. The flip cover is further configured to expose the toggle switch when in the opened position. Such a flip cover assembly may be disposed on a dashboard of a vehicle, or on a control panel of an electronic device. In one specific embodiment, when the flip cover is moved from the opened position to the closed position, it turns off the actuation device, such as by moving a toggle switch into its off position. However, it should be understood that the latch assembly is not limited to a flip cover latch assembly.

In the illustrated embodiment, the movable component 120 includes an opening 210 in the top between the first and second sidewalls 140*a,b*. The base component 110 includes a top surface 220 that is visible through the opening 210 of the top of the movable component 120 when the latch assembly 100 is in the closed position. In one embodiment, the top surface 220 of the base component 110 is illuminated. The top surface 220 of the base component 110 may also include information bearing indicia that is visible through the opening of the movable component 120 in the closed position. The information bearing indicia may identify the latch assembly itself, a component disposed below the movable component 120, or a function of the latch assembly or component.

Figure 3:
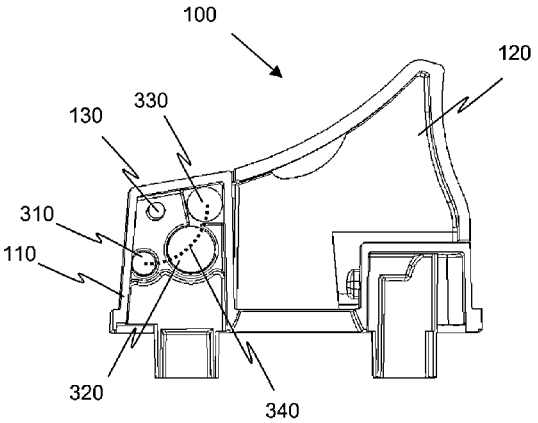
FIG. 3 is a side cutaway view of the latch assembly in a closed position.

FIG. 3 is a side cutaway view of the latch assembly 100 in a closed position. For illustrative purposes, a portion of the movable component 120 is cutaway to show the first substantially planar surface 150*a* of the base component 110.

A plurality of base magnets are disposed on the first substantially planar surface 150*a*. The plurality of base magnets includes a first base magnet 310 having a first polarity, a second base magnet 320 having a second polarity opposite the first polarity, and a third base magnet 330 having the first polarity. The plurality of base magnets are arranged on the first substantially planar surface 150*a* such that the centerlines of the first base magnet 310, second base magnet 320, and third base magnet 330 define a first arcuate path 340. In the illustrated embodiment, each of the plurality of base magnets is cylindrical or disk-shaped. In alternative embodiments (not shown), the base magnets may have any geometric shape.

In one embodiment, the first polarity is North polarity (N) or a positive polarity (+), and the second polarity is a South polarity (S) or a negative polarity (−). Alternatively, the first polarity may be a South polarity (S) or a negative polarity (−), and the second polarity is a North polarity (N) or a positive polarity (+).

In one known embodiment, the plurality of base magnets are neodymium magnets. Neodymium magnets are known to have a strong magnetic attraction. In other known embodiments, other rare earth magnets may be used, such as samarium-cobalt. However, it should be understood that any type of magnets may be employed.

Figure 4:
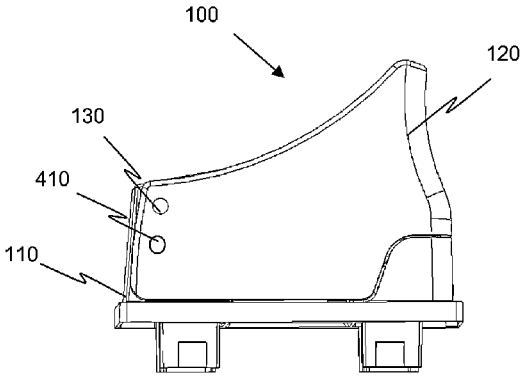
FIG. 4 is a side view of the latch assembly in the closed position.

FIG. 4 is a side view of the latch assembly 100 in a closed position. A magnet 410 is disposed on the first sidewall 140*a* of the movable component 120. In the illustrated embodiment, the magnet 410 is cylindrical or disk-shaped. In an alternative embodiment (not shown), the magnet may have any geometric shape.

The magnet 410 has the second polarity opposite the first polarity. In one known embodiment, the magnet 410 is a neodymium magnet. In other known embodiments, other rare earth magnets may be used, such as samarium-cobalt. However, it should be understood that any type of magnet may be employed.

Figure 5:
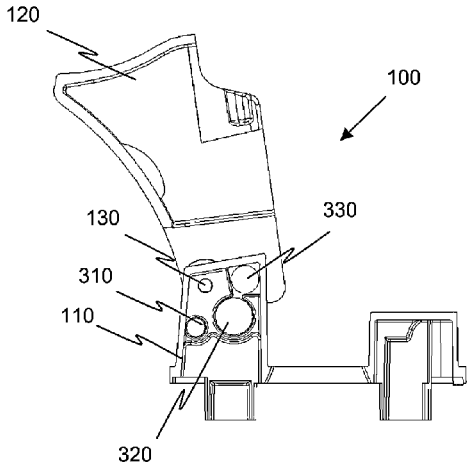
FIG. 5 is a side cutaway view of the latch assembly in an opened position.
Figure 6:
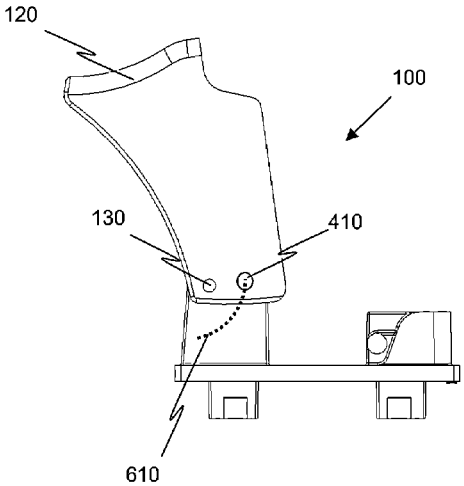
FIG. 6 is a side view of the latch assembly in the opened position with a portion of a base component removed.

FIG. 5 is a side cutaway view of the latch assembly 100 in an opened position, and FIG. 6 is a side view of the latch assembly 100 in the opened position. The movable component 120 is configured to pivot about the pin 130 from the closed position shown in FIGS. 3 and 4 to the opened position shown in FIGS. 5 and 6. This pivoting movement is now described with reference to all of FIG. 3-6.

When the movable component 120 pivots between the closed position and the opened position, a centerline of the magnet 410 moves along a second arcuate path 610. In one embodiment, the second arcuate path follows the first arcuate path, such that the centerline of the magnet 410 moves over the centerlines of each of the plurality of base magnets 310, 320, 330. In an alternative embodiment, the second arcuate path is offset from the first arcuate path.

The first base magnet 310 defines a closed position of the movable component 120 when the magnet 410 in the movable component 120 is aligned with the first base magnet 310 on the base component 110. In one embodiment, the magnet 410 is aligned with the first base magnet 310 in the closed position, such that the magnet 410 has the same centerline as the first base magnet 310. In an alternative embodiment, the magnet 410 is aligned with the first base magnet 310 in the closed position such that the centerline of the magnet 410 is at a location on the second arcuate path 610 that is closest to the centerline of the first base magnet 310.

The Third base magnet 330 defines an open position of the moveable component 120 when the magnet 410 in the moveable component 120 is aligned with the third base magnet 330 on the base component 110. In one embodiment, the magnet 410 is aligned with the third base magnet 330 in the opened position, such that the magnet 410 has the same centerline as the third base magnet 330. In an alternative embodiment, the magnet 410 is aligned with the third base magnet 310 in the opened position such that the centerline of the magnet 410 is at a location on the second arcuate path 610 that is closest to the centerline of the third base magnet 330.

The second base magnet 320 defines an intermediate position of the movable component 120 between the closed position and the opened position when the magnet 410 in the movable component 120 is aligned with the second base magnet 320 on the base component 110. In one embodiment, the magnet 410 is aligned with the second base magnet 320 in the intermediate position, such that the magnet 410 has the same centerline as the second base magnet 320. In an alternative embodiment, the magnet 410 is aligned with the second base magnet 310 in the intermediate position such that the centerline of the magnet 410 is at a location on the second arcuate path 610 that is closest to the centerline of the second base magnet 320.

Because the magnet 410 has the second polarity, it is attracted to the first base magnet 310 and to the third base magnet 330, and is repelled from the second base magnet 320. Accordingly, the magnet 410 and the plurality of base magnets 310, 320, 330 bias the movable component 120 towards the closed position and the opened position, and away from the intermediate position. Specifically, the first base magnet 310 and the second base magnet 320 act to bias the magnet 410 and the movable component 120 towards the closed position. Additionally, the second base magnet 330 and the third base magnet 330 act to bias the magnet 410 and the movable component 120 towards the opened position.

In operation, when the movable component 120 is in the closed position, it will remain in the closed position until a user applies an initial opening force to overcome the attractive force between the magnet 410 and the first base magnet 310. When such an initial opening force is applied, the magnet 410 of the movable component 120 is further acted on by the repelling force of the second base magnet 320 and the attractive force of third base magnet 330 to bias the moving component 120 to the opened position. This action may be described as a spring or snap action.

Likewise, when the movable component 120 is in the opened position, it will remain in the opened position until a user applies an initial closing force to overcome the attractive force between the magnet 410 and the third base magnet 330. When such an initial closing force is applied, the magnet 410 of the movable component 120 is further acted on by the repelling force of the second base magnet 320 and the attractive force of first base magnet 310 to bias the moving component 120 to the closed position. This action may also be described as a spring or snap action.

In the illustrated embodiment, the third base magnet 330 is larger than the first base magnet 310. Additionally, the second base magnet 320 is larger than both the first base magnet 310 and third base magnet 330. Here, the second base magnet 320 has a diameter twice as large as the diameter of the first base magnet 310. The magnet 410 is the same size as the third base magnet 330. In an alternative embodiment (not shown), each of the base magnets is the same size. As one of ordinary skill in the art would understand, the size and position of the base magnets may be varied to achieve a desirable torque on the movable component.

Figure 7:
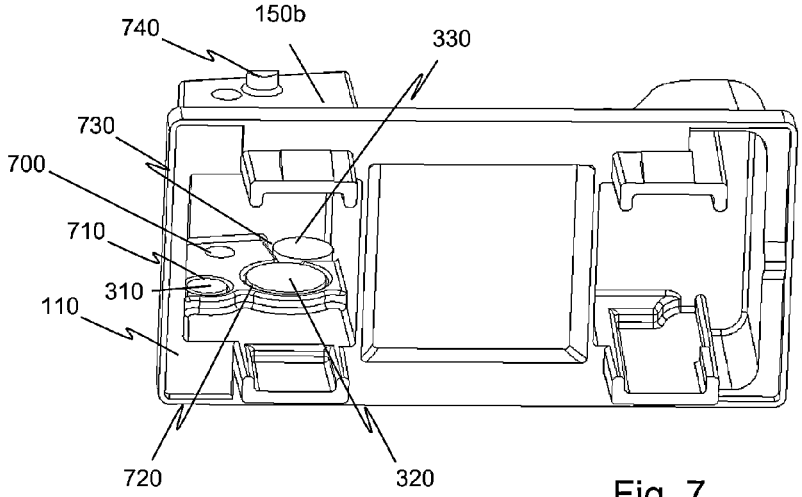
FIG. 7 is a bottom perspective view of the base component of the latch assembly.

FIG. 7 is a bottom perspective view of the base component 110 of the latch assembly 100. In the illustrated embodiment, the base component 110 is hollow, and the base magnets 310, 320, 330 are disposed on a bezel 700 of the first substantially planar surface 150*a*. The bezel 700 includes a first recess 710 that receives the first base magnet 310, a second recess 720 that receives the second base magnet 320, and a third recess 730 that receives the third base magnet 330. In an alternative embodiment (not shown), the base magnets may be disposed in recesses on an external surface of the base component.

As can also be seen in FIG. 7, an end stop 740 is also disposed on the first substantially planar surface 150*a*. The end stop 740 controls the end position of the movable component 120 in a manner that is more fully described below.

Figure 8:
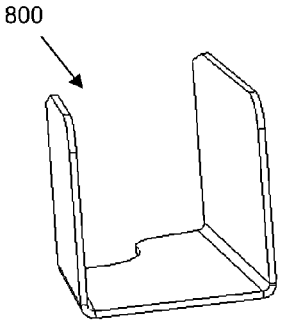
FIG. 8 is a perspective view of one embodiment of a retainer.
Figure 9:
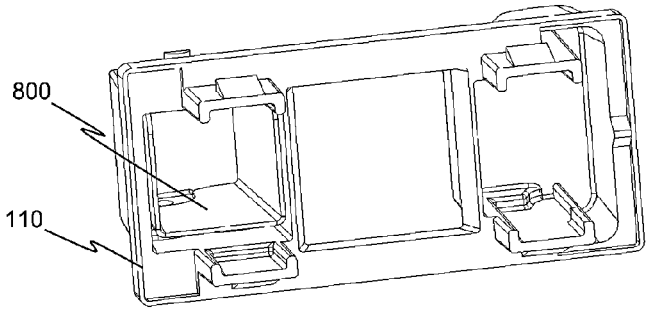
FIG. 9 is a bottom perspective view of the base component of the latch assembly with a retainer.

FIG. 8 is a perspective view of one embodiment of a retainer 800. FIG. 9 is a bottom perspective view of the base component 110 with the retainer 800 in place. The retainer 800 is shaped to be received in the hollow portion of the base component 110 and to hold the base magnets 310, 320, 330 in the respective recesses 710, 720, 730 shown in FIG. 7. In one embodiment, the retainer 800 is constructed of 400 series stainless steel and acts as a flux concentrator that effectively increases the strength of the base magnets 310, 320, 330. In an alternative embodiment, the retainer may be constructed of carbon steel, or any metal. In another alternative embodiment, the retainer may be constructed of a polymeric material. As one of ordinary skill in the art would understand, magnetic materials will function as a flux concentrator, but non-magnetic materials will not perform such a function.

Figure 10:
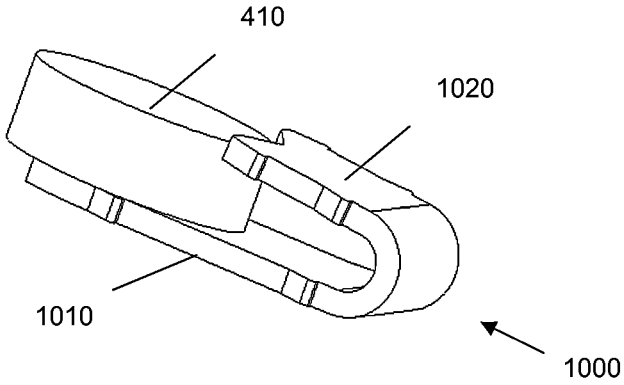
FIG. 10 is a perspective view of one embodiment of a magnet and clip.

FIG. 10 is a perspective view of one embodiment of the magnet 410 and a clip 1000. The clip 1000 includes a long arm 1010 that receives the magnet 410 and a short arm 1020 that supports the magnet 410. In one embodiment, the clip 1000 is constructed of metal. In an alternative embodiment, the clip may be constructed of a polymeric material. As one of ordinary skill in the art would understand, a clip constructed of magnetic material will function as a flux concentrator, but a clip constructed of a non-magnetic material will not perform such a function.

Figure 11:
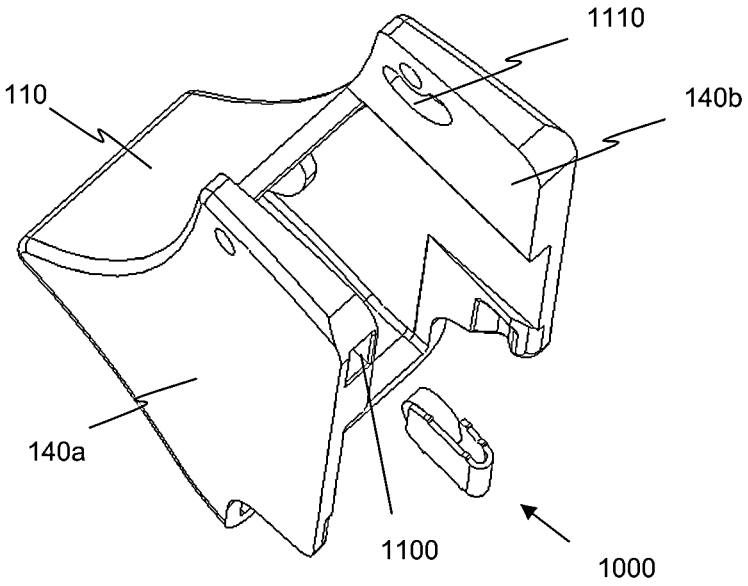
FIG. 11 is an exploded view of one embodiment of a movable component of the latch assembly and magnet and clip.

FIG. 11 is an exploded view of the movable component 110 and a magnet 410 and clip 1000. In the illustrated embodiment, the movable component 110 includes a recess 1100 configured to receive the magnet 410 and the clip 1000. The clip 1000 is configured such that the long arm 1010 and short arm 1020 are pressed towards each other to be received in the recess 1100. When the clip 1000 is in place, the long arm 1010 and short arm 1020 are biased away from each other and press against the recess 1100, creating a press fit that keeps the clip 1000 and the magnet 410 in the recess 1100 while the movable component 110 pivots.

As can also be seen in FIG. 11, the second sidewall 140*b* further includes an arcuate groove 1110 configured to receive the end stop 740 of the base component. A similar arcuate groove (not shown) is disposed on the first sidewall 140*a*. When the movable component 120 pivots about the pin 130, the arcuate grooves 1110 in the sidewalls 140*a,b* moves about the end stops 740 on the base component 110. When ends of the grooves 1110 contact the end stops 740, the pivoting motion of the movable component 120 is arrested, and the latch assembly 100 is in the opened position. In an alternative embodiment (not shown), end stops are disposed on sidewalls of the movable component, and grooves are disposed on a surface of the base component. It should be understood that grooves and end stops may be disposed on a single side of the latch assembly, or completely omitted.

In an alternative embodiment (not shown), the magnet may be disposed on an external surface of the movable component. In another alternative embodiment (not shown), portions of a sidewall of the movable component may be constructed of a magnetic material.

Although the embodiment illustrated in FIGS. 1-11 includes three base magnets on a first substantially planar surface of the base component, and a single magnet on a first sidewall of the movable component, it should be understood that the number and location of magnets may be varied. In one alternative embodiment, four or more base magnets may be disposed on a surface of the base component. In another alternative embodiment, two or more magnets may be disposed on the sidewall of the movable component.

Figure 12:
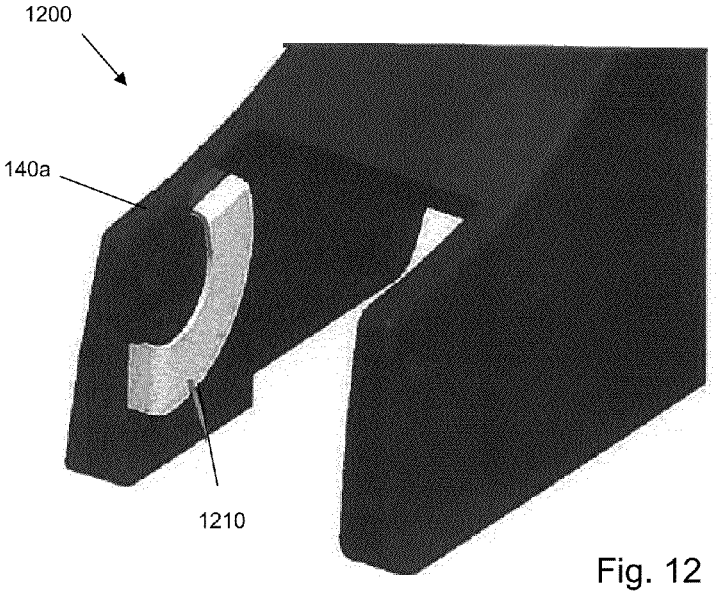
FIG. 12 is a perspective view of a movable component of an alternative embodiment of a latch assembly.

In yet another alternative embodiment, three magnets are disposed on the movable component, and a single magnet is disposed on the surface of the base component. In still another alternative embodiment, three base magnets are disposed on a first surface of the base component, and three additional base magnets are disposed on a second surface of the base component, opposite the first surface. In such an embodiment, a first magnet is disposed on a first sidewall of the movable component, and a second magnet is disposed on a second sidewall of the movable component, opposite the first sidewall FIG. 12 is a perspective view of a movable component 1200 of an alternative embodiment of a latch assembly. The movable component 1200 is substantially the same as the movable component 120 described above, except for the differences described herein. Like reference numerals are used to indicate like components.

The movable component 1200 includes an arcuate magnetic rail 1210 disposed on a first sidewall 140*a*. The arcuate magnetic rail 1210 is used in place of the magnet 410 described above. The magnetic rail 1210 is constructed of a metal having magnetic properties, such as 400 series stainless steel, carbon steel, or other magnetic metal.

Figure 13:
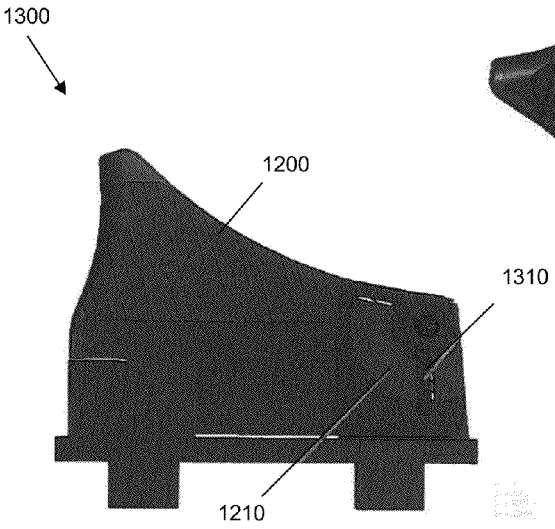
FIG. 13 is a side view of the alternative embodiment of the latch assembly in a closed position.
Figure 14:
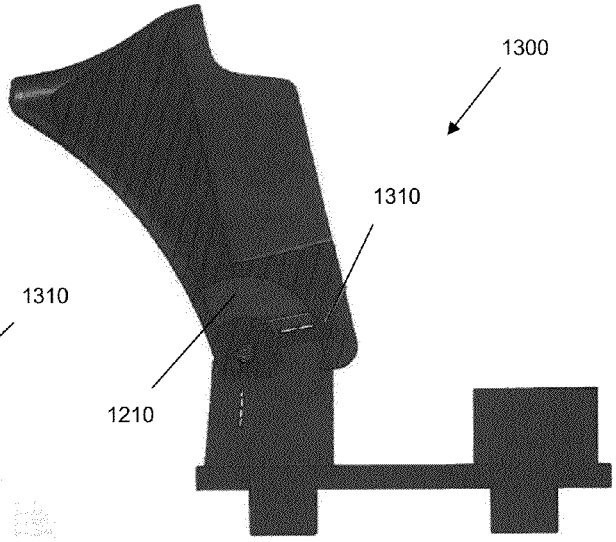
FIG. 14 is a side view of the alternative embodiment of the latch assembly in an opened position.

FIGS. 13 and 14 are side views of an alternative embodiment of a latch assembly 1300 in a closed position, and an opened position, respectively. The latch assembly 1300 is substantially the same as the latch assembly 100 described above, except for the differences described herein. Like reference numerals are used to indicate like components.

The latch assembly 1300 includes the movable component 1200 pivotally connected to a base component 1310. The base component includes a magnet 1320 that surrounds a portion of the magnetic rail 1210. The magnet 1320 may have any polarity—magnets of either polarity will attract the magnetic rail 1210. This attraction causes drag when the movable component 1300 is pivoted between a closed position and an opened position. Such drag may be desirable to provide the user with a tactile resistance to a force or motion.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Additionally, to the extent that the terms "on" or "onto" are used in the specification or the claims, it is intended to additionally mean "in," "into," or "near." Furthermore, to the extent the term "connect" is used in the specification or claims, it is intended to mean not only "directly connected to," but also "indirectly connected to" such as connected through another component or components.

While the present disclosure has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the disclosure, in its broader aspects, is not limited to the specific details, the representative apparatus and method, and illustrative examples shown and described. Accordingly, departures may be made from such details without departing from the spirit or scope of the applicant's general inventive concept.

What is claimed is:

1. A magnetic latch comprising:

a base component having at least one substantially planar surface and at least three base magnets disposed on the substantially planar surface, such that centerlines of the at least three base magnets define a first arcuate path, the base magnets including:

a first base magnet having a first polarity, a second base magnet having a second polarity opposite the first polarity, and a third base magnet having the first polarity; wherein the second base magnet is disposed between the first base magnet and the third base magnet along the first arcuate path; and a movable component pivotally connected to the base component adjacent to the at least one substantially planar surface, wherein the movable component is configured to pivot between a closed position and an opened position and comprises at least one magnet disposed on the movable component such that a centerline of the magnet disposed on the movable component moves along a second arcuate path as the movable component pivots between the closed position and the opened position, wherein the magnet disposed on the movable component has the second polarity opposite the first polarity; and wherein the movable component latches in the closed position when the first base magnet and the magnet disposed on the movable component are aligned and attracted to one another; and wherein the movable component is in the opened position when the third base magnet and the magnet disposed on the movable component are aligned and attracted to one another.

2. The magnetic latch of claim 1, wherein the movable component includes a first sidewall pivotally connected to the substantially planar surface of the base component, and a second sidewall pivotally connected to an opposite surface of the base component.

3. The magnetic latch of claim 2, wherein the movable component further includes a top surface having an opening.

4. The magnetic latch of claim 3, wherein the base component includes a top surface that is visible through the opening of the top of the movable component when the movable component is in the closed position.

5. The magnetic latch of claim 4, wherein the top surface of the base component is illuminated.

6. The magnetic latch of claim 1, further comprising a plurality of retainers that retain the at least three base magnets and the magnet disposed on the movable component.

7. The magnetic latch of claim 6 wherein the plurality of retainers are flux concentrators.

8. The magnetic latch of claim 1, wherein the second arcuate path is offset from the first arcuate path.

9. The magnetic latch of claim 1, wherein the second arcuate path follows the first arcuate path, such that the centerline of the magnet disposed on the movable component moves over the centerlines of each of the at least three base magnets.

10. A magnetic flip cover latch assembly comprising:

a base component having at least a first magnet, a second magnet, and a third magnet disposed thereon; and a flip cover pivotally connected to the base component and configured to pivot between an opened position and a closed position, the flip cover having a fourth magnet disposed thereon, wherein the first magnet has a polarity that attracts the fourth magnet, retaining the flip cover in the closed position;

wherein the second magnet is disposed between the first base magnet and a third base magnet and has a polarity that repels the fourth magnet; and wherein the third magnet has a polarity that attracts the fourth magnet, retaining the flip cover in the opened position.

11. The magnetic flip cover latch assembly of claim 10, wherein the first, second, and third magnets are disposed on a sidewall of the base component.

12. The magnetic flip cover latch assembly of claim 11, wherein the sidewall of the base component includes a bezel that receive the first, second, and third magnets.

13. The magnetic flip cover latch assembly of claim 10, further comprising a flux concentrator adjacent at least one of the first, second, and third magnets.

14. The magnetic flip cover latch assembly of claim 10, wherein the flip cover includes an opening.

15. The magnetic flip cover latch assembly of claim 14, wherein the base component includes information bearing indicia that is visible through the opening of the flip cover when the flip cover is in the closed position.

16. The magnetic flip cover latch assembly of claim 10, wherein the third magnet is larger than the first magnet.

17. The magnetic flip cover latch assembly of claim 10, wherein the second magnet is larger than the first magnet and the third magnet.

18. A magnetic flip cover latch assembly comprising:

a base component having at least three magnets disposed thereon, the at least three magnets including first, second, and third base component magnets; and a flip cover pivotally connected to the base component and configured to pivot between an open position and a closed position, the flip cover including a flip cover magnet disposed thereon, wherein the first and second base component magnets act on the flip cover magnet to bias the flip cover to the open position, wherein the first base component magnet attracts the flip cover magnet towards the open position while the second base component magnet repels the flip cover magnet away from an intermediate position, and wherein the second and third base component magnets act on the flip cover magnet to bias the flip cover to the closed position, wherein the third base component magnet attracts the flip cover magnet towards the closed position while the second base component magnet repels the flip cover magnet away from an intermediate position.

* * * * *